US009687978B2

(12) United States Patent
Kumar

(10) Patent No.: US 9,687,978 B2
(45) Date of Patent: Jun. 27, 2017

(54) VARIABLE SPEED CONTROL OF FLUID DRIVEN MOTORS

(71) Applicant: Ingersoll-Rand Company, Davidson, NC (US)

(72) Inventor: Sanjeev Kumar, Bangalore (IN)

(73) Assignee: Ingersoll-Rand Company, Davidson, NC (US)

( * ) Notice: Subject to any disclaimer, the term of this patent is extended or adjusted under 35 U.S.C. 154(b) by 828 days.

(21) Appl. No.: 13/958,321

(22) Filed: Aug. 2, 2013

(65) Prior Publication Data

US 2014/0034345 A1 Feb. 6, 2014

Related U.S. Application Data

(60) Provisional application No. 61/679,038, filed on Aug. 2, 2012.

(51) Int. Cl.

| | |
|---|---|
| ***B25F 5/00*** | (2006.01) |
| ***B25F 5/02*** | (2006.01) |
| ***F01C 13/02*** | (2006.01) |
| ***F01C 20/08*** | (2006.01) |
| ***F01C 21/18*** | (2006.01) |

(52) U.S. Cl.

CPC ..... *B25F 5/005* (2013.01); *F01C 13/02* (2013.01); *F01C 20/08* (2013.01); *F01C 21/186* (2013.01)

(58) Field of Classification Search

CPC .... B25F 5/00; B25F 5/02; B25F 5/001; B25F 5/005

USPC ..... 173/218, 221, 168, 169

See application file for complete search history.

(56) References Cited

U.S. PATENT DOCUMENTS

| | | | | |
|---|---|---|---|---|
| 2,995,114 A | | 8/1961 | Starr | |
| 3,298,284 A | | 1/1967 | Alexander | |
| 3,326,240 A | * | 6/1967 | McConnaughay | ..... B25B 21/00 137/630.14 |

(Continued)

FOREIGN PATENT DOCUMENTS

| | | |
|---|---|---|
| CN | 1603635 A | 4/2005 |
| CN | 1759253 A | 4/2006 |

(Continued)

OTHER PUBLICATIONS

International Search Report for PCT/US2013/053494 dated Nov. 8, 2013, 2 pages.

(Continued)

*Primary Examiner* — Andrew M Tecco
*Assistant Examiner* — Praachi M Pathak
(74) *Attorney, Agent, or Firm* — Taft Stettinius & Hollister LLP

(57) ABSTRACT

An apparatus is disclosed that includes a fluid inlet in fluid communication with a valve assembly, the valve assembly structured to selectively permit the flow of a motive fluid from the fluid inlet to a fluid driven motor, wherein the valve assembly further includes a first plunger including a plurality of axially extending fluid channels, wherein the plunger is selectively movable by an actuator in a manner such that as the plunger is displaced farther away from a closed position, the number of axially extending fluid channels placed in fluid communication with the fluid inlet increases, and wherein the axially extending fluid channels permit the flow of the motive fluid from the fluid inlet to the fluid driven motor.

15 Claims, 6 Drawing Sheets

(56) References Cited

U.S. PATENT DOCUMENTS 3,590,875 A * 7/1971 Northcutt ..... F01C 1/344 137/630.14
3,635,605 A * 1/1972 Hall ..... B23B 45/04 123/387
3,696,834 A * 10/1972 Vonhoff, Jr. ..... B25B 23/145 137/596
3,970,110 A * 7/1976 Schaedler ..... B25B 21/00 137/613
4,024,892 A * 5/1977 Prisco ..... B25B 21/00 137/630.14
4,380,270 A * 4/1983 Ludwig ..... F03B 13/00 173/221
4,476,942 A * 10/1984 Elkin ..... B25F 5/00 173/168
5,417,294 A * 5/1995 Suher ..... B25D 9/14 173/15
5,797,462 A * 8/1998 Rahm ..... B25B 21/00 173/169
5,918,686 A 7/1999 Izumisawa
6,161,628 A 12/2000 Liu
6,443,239 B1 * 9/2002 Izumisawa ..... B25B 21/02 173/168
6,902,011 B2 6/2005 Hall
7,311,155 B2 12/2007 Chang
7,461,704 B2 * 12/2008 Chen ..... B25F 5/00 173/169
7,784,391 B2 8/2010 Vallebrant et al.
7,886,840 B2 2/2011 Young et al.
8,020,630 B2 9/2011 Amend et al.
8,201,580 B2 6/2012 Tondolo
8,430,184 B2 * 4/2013 Bass ..... F16K 11/105 173/169
8,540,034 B2 * 9/2013 Poncet ..... B25D 9/04 173/114
8,739,832 B2 * 6/2014 Young ..... F16K 11/072 137/625.46
9,555,532 B2 1/2017 Amend et al.
2006/0278416 A1 12/2006 Tanji
2007/0011884 A1 1/2007 Hua et al.
2008/0023208 A1 * 1/2008 Sterling ..... F16K 17/30 173/169
2010/0300716 A1 * 12/2010 Amend ..... B25B 21/026 173/93
2012/0055690 A1 3/2012 Uemura
2013/0081843 A1 * 4/2013 Tully ..... B25F 5/02 173/221
2013/0319714 A1 * 12/2013 Su ..... B25B 21/00 173/221
2014/0034345 A1 * 2/2014 Kumar ..... B25F 5/005 173/169
2014/0034349 A1 * 2/2014 Kumar ..... B25F 5/005 173/221
2016/0075008 A1 * 3/2016 Wu ..... B25F 5/001 173/221

FOREIGN PATENT DOCUMENTS

CN 101575987 A 11/2009
CN 101939577 A 1/2011
CN 202148555 U 2/2012
CN 102448675 A 5/2012

OTHER PUBLICATIONS

Written Opinion of the International Searching Authority for PCT/US2013/053494 dated Nov. 8, 2013, 4 pages.
Chinese Patent Office, Office Action issued in corresponding Application No. 201380051684.1, dated Apr. 6, 2016, 16 pp.
European Extended Search Report; European Patent Office; European Application No. 13824748.1; dated Jun. 30, 2016; 10 pages.

* cited by examiner

VARIABLE SPEED CONTROL OF FLUID DRIVEN MOTORS

CROSS REFERENCE TO RELATED APPLICATIONS

The present application claims the benefit of U.S. Provisional Patent Application No. 61/679,038, filed Aug. 2, 2012, and is incorporated herein by reference.

FIELD OF THE INVENTION

The present invention generally relates to fluid driven motors, and more particularly, but not exclusively, to variable motor speed control of fluid driven machinery, including fluid driven tools.

BACKGROUND OF THE INVENTION

Speed control of fluid powered motors, specifically in the area of fluid driven machinery remains an area of interest. Many current designs provide maximum flow to the motor; and therefore, maximum motor speed immediately after a flow of fluid from an inlet valve is initiated. Therefore, further technological developments are desirable in this area.

BRIEF SUMMARY OF THE INVENTION

One embodiment of the present invention is a unique speed control device providing variable speed motor control for fluid driven motors. Other embodiments include apparatuses, systems, devices, hardware, methods, and combinations for motor speed control for fluid powered machinery. Further embodiments, forms, features, aspects, benefits, and advantages of the present application shall become apparent from the description and figures provided herewith.

BRIEF DESCRIPTION OF THE SEVERAL VIEWS OF THE DRAWINGS

The description herein makes reference to the accompanying figures wherein like reference numerals refer to like parts throughout the several views, and wherein.

DETAILED DESCRIPTION OF THE INVENTION

Figure 1:
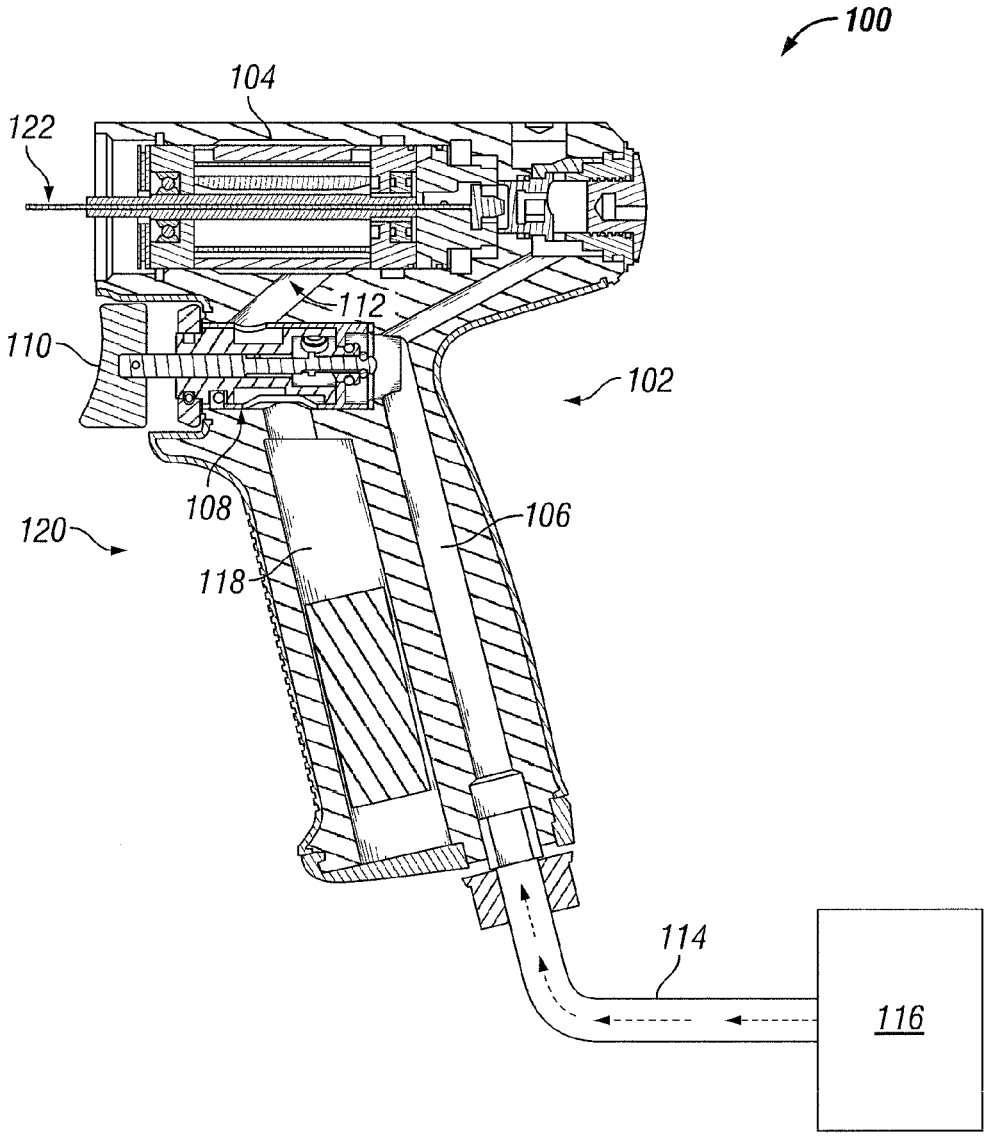
FIG. 1 depicts an embodiment of a fluid driven machine including a variable valve assembly.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, one embodiment is disclosed of a fluid powered machine 100 including a housing 102 and a fluid driven motor 104. It is contemplated that the fluid powered device 100 can include a variety of fluid powered devices such as pumps, presses, hoists, grain elevators, or any other fluid powered device 100. In some embodiments, the fluid powered device 100 can be a power tool including, but not limited to a drill, ratchet, chisel, grinder, or the like. In one form, the fluid powered device 100 is a handheld pneumatic tool which includes a hand grip 120.

The motive fluid 114 can be any fluid capable powering the fluid driven motor 104. The motive fluid 114 can be a compressible gas. Air 114 can be utilized as the motive fluid 114, which is received from a pressure source 116. The pressure source 116 can include various compressors, pistons, pressurized tanks, or any other device which is capable of exerting or retaining pressure on the motive fluid 114. In one form, the pressure source 116 is an oil free screw air compressor.

The fluid driven motor 104 can be any device which is capable of extracting energy from the motive fluid 114 and being driven thereby. The fluid driven motor 104 can be a piston, turbine, rotor, screw drive, or any other such device. The fluid driven motor 104 can be a turbine which converts the potential energy stored in the pressurized air 114 into rotational motion to be harnessed at a motor shaft output 122.

A fluid inlet 106 allows the motive fluid 114 to flow into a valve assembly 108. The fluid inlet 106 may include various flanges, fittings, etc., on an end opposite the valve assembly 108, to provide ease of coupling with respect to the pressure source 116. In some forms, the housing 102 can include a pressure chamber 118 to store a portion of motive fluid 114 to ensure consistent flow to the valve assembly 108.

The valve assembly 108 is operated by an actuator 110. The actuator 110 can take a variety of forms including, but not limited to, electronic or manual actuators such as linear actuators, hydraulic actuators, motor driven actuators, solenoids, or the like. The actuator 110 can receive an input from a location near the actuator, such as is illustrated in FIG. 1, or can receive an input signal from a distant location such as a push button (not shown) for use with a pneumatic hoist, as one non-limiting example. The actuator 110 can be a trigger 110 which provides a mechanical force to the valve assembly 108.

Figure 2A:
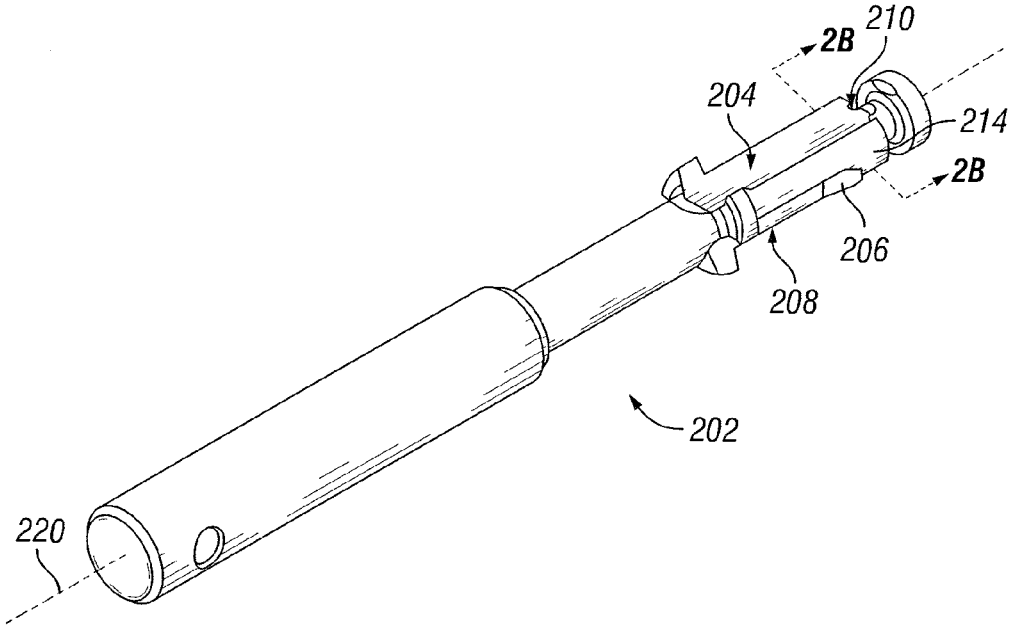
FIGS. 2A-2B depict an embodiment of a plunger including a plurality of axially disposed fluid channels.
Figure 2B:
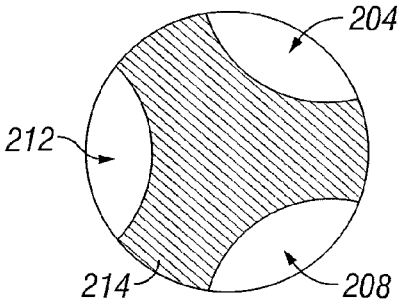

The valve assembly 108 permits the selective release of the motive fluid 114 from the fluid inlet 106 to an inlet 112 of the fluid driven motor 104. Referring to FIGS. 2A and 2B, the valve assembly 108 includes at least one plunger 202. The plunger 202 includes a plurality of axially extending fluid channels 204, 208, 212 located in a plunger body 214. The axially extending fluid channels 204, 208, 212 can be grooves in the plunger body 214, apertures extending within the plunger body 214 and having an intake 206, 210, or can be any other passageway which permits the flow of fluid from an intake 206, 210 of the axially extending fluid channel 204 to an exit of the axially extending fluid channel 204, wherein the exit is in flow communication with the fluid driven motor 104.

Each of the plurality of axially extending fluid channels 204, 208, 212 includes a fluid intake 206, 210, 306. The fluid intakes 206, 210, 306 are disposed axially in relation to each of the other fluid intakes 206, 210, 306. An axis 220 is a reference axis for use in describing axial relationships as well as movement along an axis; however, the axial relationships and axial movements are not meant to be limited by axis 220. In some forms, the fluid intakes 206, 210, 306 and corresponding axially extending channels 204, 208, 212 can be disposed circumferentially with relation to each other as is illustrated in FIG. 2B.

Figure 3:
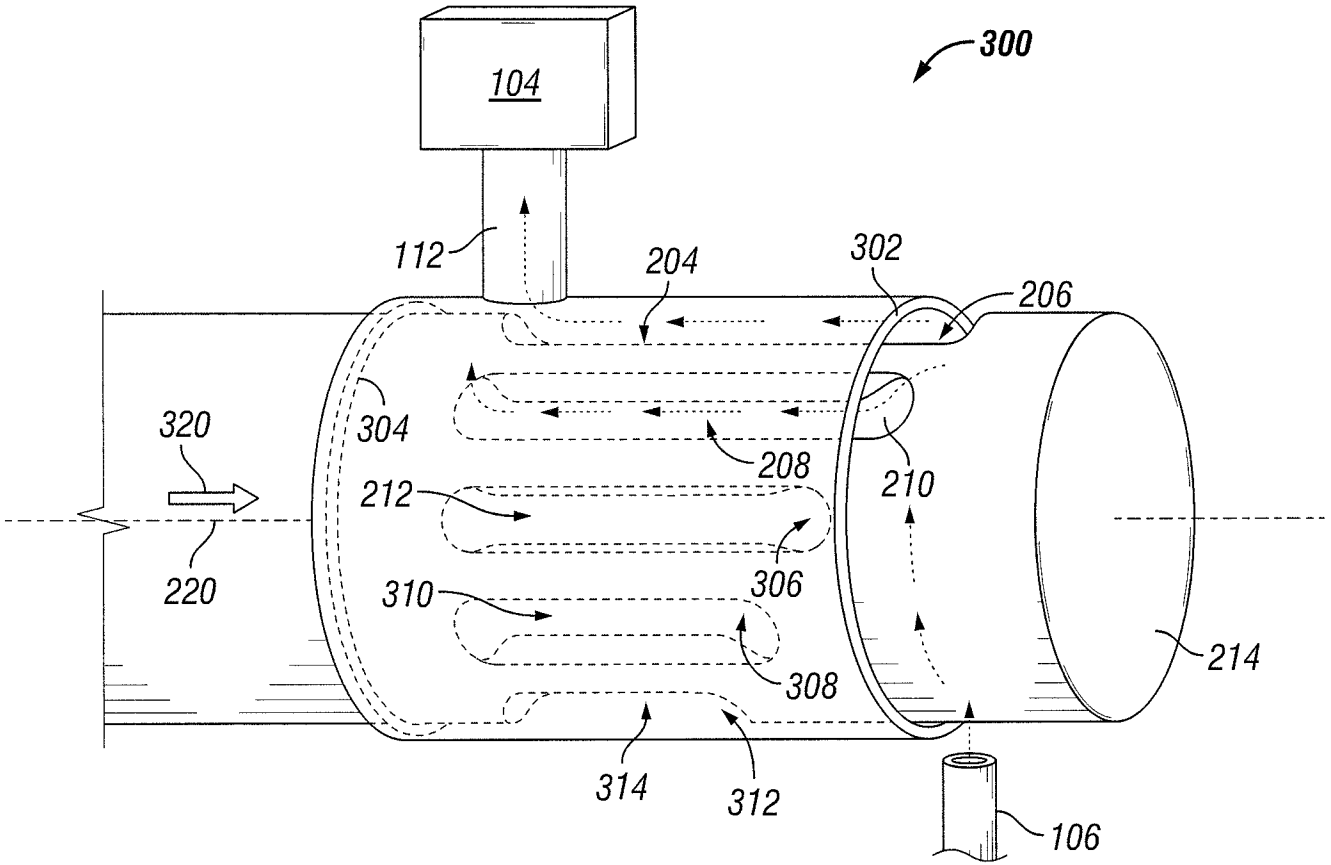
FIG. 3 depicts an embodiment of a plunger assembly.

Referring to FIG. 3, any number of axially extending fluid channels can be incorporated into the plunger body 214 depending upon the specific application, manufacturing capabilities, and any cost to benefit analysis associated therewith. As will be explained below, the number of axially extending fluid channels can determine the number of speeds at which the fluid driven motor 104 can operate. FIG. 3 illustrates a plunger assembly 300 including five axially extending channels 204, 208, 212, 310, 314 and corresponding intakes 206, 210, 306, 308, 312. In this non-limiting embodiment, the plunger body 214 is capable of providing five different fluid flows to the fluid driven motor 104; therefore, driving the fluid driven motor 104 at five different speeds. The plunger assembly 300 includes a plurality of sealing members 302 and 304 meant to segregate the inlet 106 from the inlet 112 of the fluid driven motor 104. The sealing members 302 and 304 can be O-rings, gaskets, or any other devices capable of performing a sealing or semi-sealing function, depending on the specific application. In some forms, the sealing members 302 and/or 304 can be incorporated into various wall members or other housing structures of the valve assembly 108, can be incorporated into one or more plungers, or the one or more plungers can themselves form the sealing members 302 and/or 304.

As the plunger body 214 is displaced linearly by the actuator 110, along the axis 202 in the direction illustrated at 320, the first intake 206 of the axially extending channel 204 is placed in fluid communication with the fluid inlet 106. As the plunger body 214 is displaced further in the direction illustrated by 320, the second intake 210 is placed in fluid communication with the fluid inlet 106. The motive fluid 114 can pass from the fluid inlet 106 through the fluid intakes 206 and 210, traversing the axially extending fluid channels 204, 208, and enter the fluid driven motor 104 through the inlet 112 of the fluid driven motor 104. As illustrated, the remainder of the intakes 306, 308, and 314 have not been placed in fluid communication with the fluid inlet 106 as the sealing member 302 prevents the motive fluid 114 from entering therein. Therefore, in this illustration, the motor 204 is only receiving motive fluid 114 from two of a potential five channels.

Figure 4:
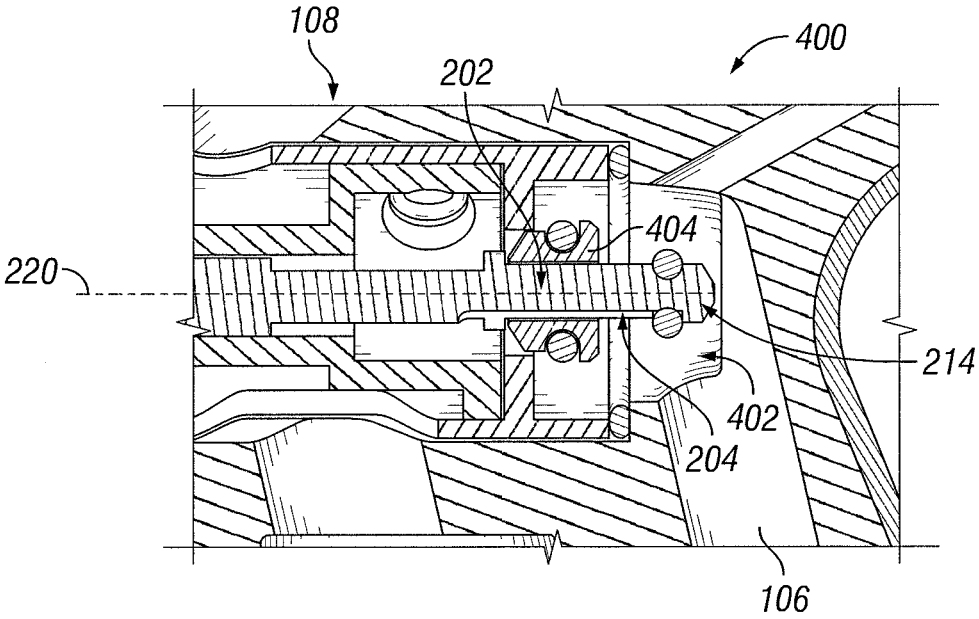
FIG. 4 depicts an embodiment of a variable valve assembly including multiple plungers.

The valve assembly 108 can include more than one plunger. FIG. 4 illustrates a cut away view 400 of the valve assembly 108 including a second plunger 404. In some forms, the second plunger 404 can be located around the first plunger 202. Upon full displacement of the first plunger 202, the second plunger 404 can be displaced, providing a maximum motive fluid 114 flow. The second plunger 404 can additionally or alternatively contain a plurality of axially extending fluid channels through which the motive fluid 114 traverses upon the linear displacement of the second plunger 404, as was discussed with reference to the first plunger 202. In providing the second plunger 404 with a plurality of axially extending fluid channels, the number of total fluid driven motor 104 speeds can be increased.

Additionally, FIG. 4 illustrates that a portion of the fluid inlet 106 and an inlet 402 of the valve assembly 108 can be disposed in a perpendicular or approximately perpendicular relationship. However, any configuration with relation to fluid inlet 106 and inlet 402 can be utilized depending upon the specific application and flow desired.

Figure 5A:
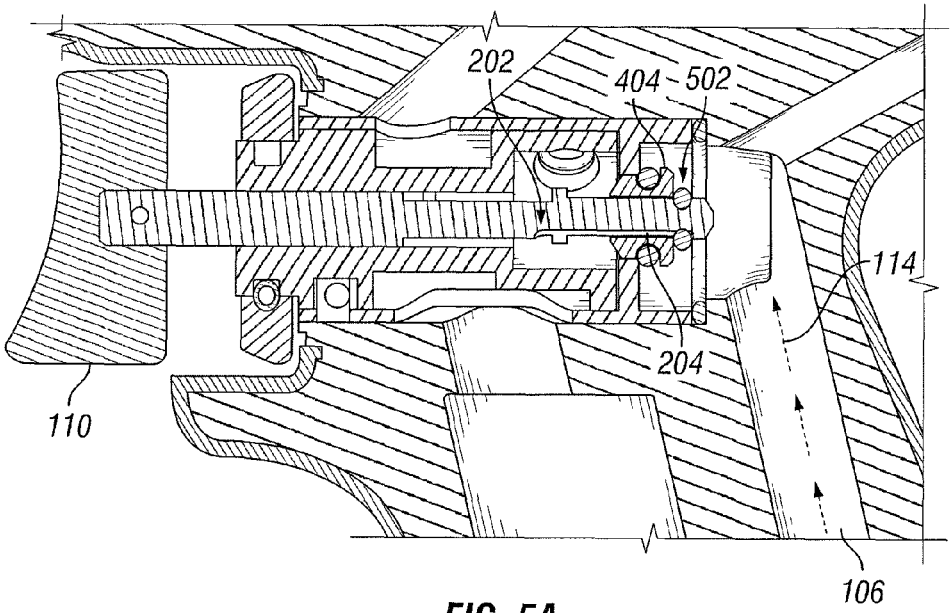
FIGS. 5A-5C depict embodiments of the variable valve assembly in various modes of operation.
Figure 5B:
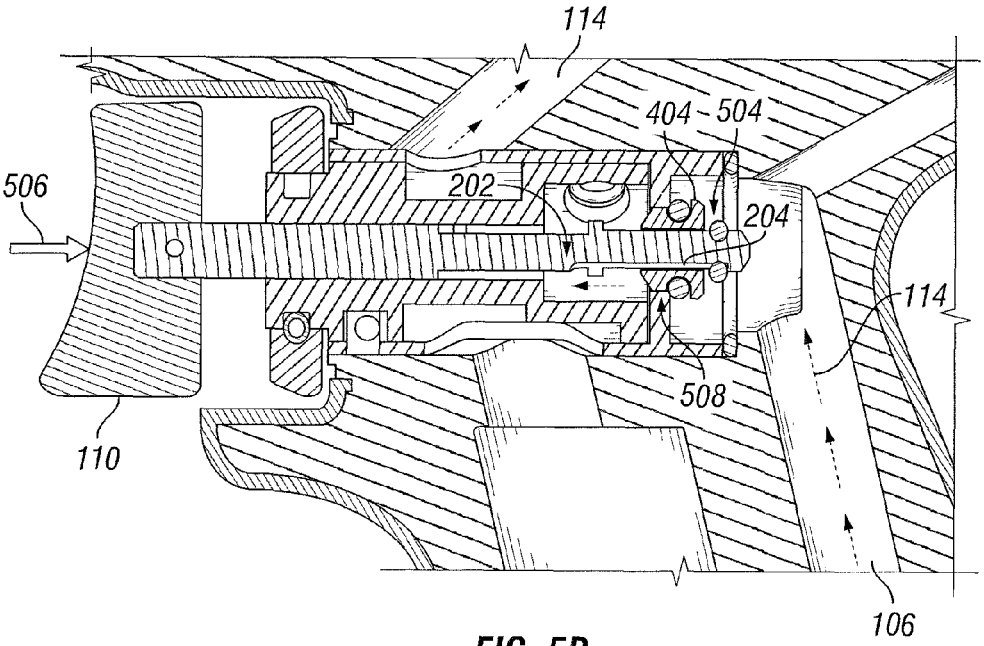
Figure 5C:
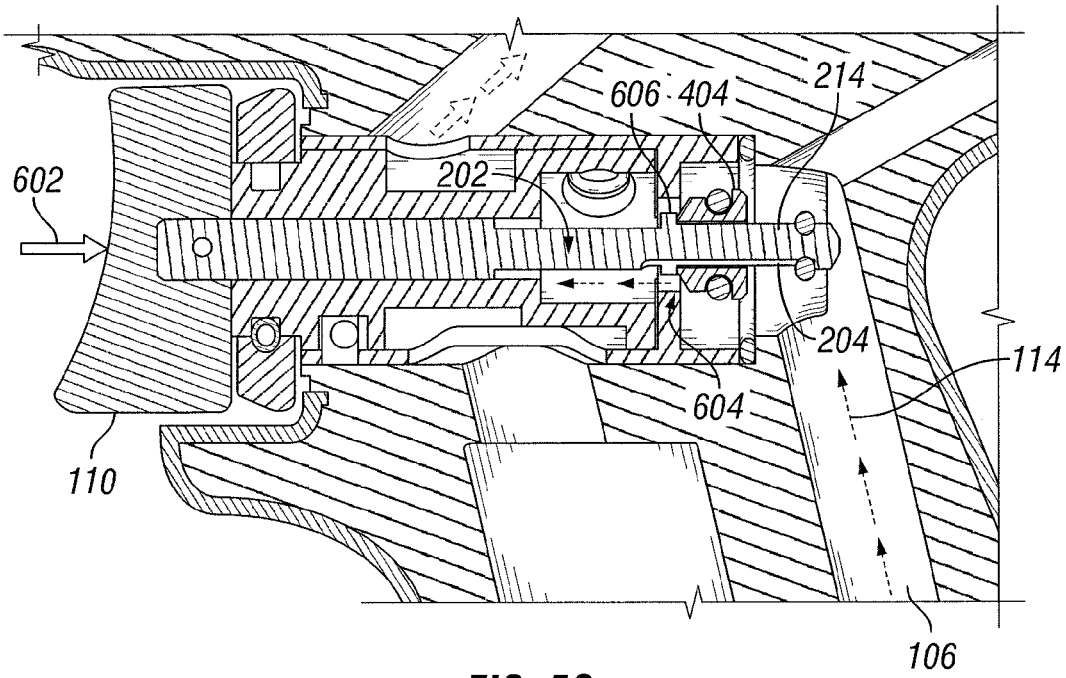

Referring now to FIGS. 5A-5C, various illustrative modes of valve assembly 108 operation will be discussed. Referring to FIG. 5A, the trigger 110 is not depressed and the plunger 202 is located at a first position 502. The plungers 202 and 404, acting as sealing member 302, block the fluid intake 204, and other fluid intakes (not shown), and effectively prevent the release of motive fluid 114 to the fluid driven motor 104 such that the fluid driven motor 104 is not powered.

Referring to FIG. 5B, a manual force 506 is exerted on the trigger such that the first plunger 202 is moved from the first position 502 to a second position wherein the motive fluid 114, received from the fluid inlet 106, enters a first axially extending fluid channel 204, and the motive fluid 114 is directed to the fluid driven motor 104. As the trigger 110 continues to be depressed, the plunger 202 is directed to a third position where a second axially extending fluid channel 208 is also placed in flow communication with the fluid inlet 106. In this second position, the motive fluid 114 received from the fluid inlet 106 traverses both the first and second axially extending fluid channels 204, 208 and is directed toward the fluid driven motor 104. As the trigger 110 is depressed further, a third through $n^{th}$ position can be reached, wherein n is the total number of channels disposed in the plunger body 214.

As each position is reached, the axially extending fluid channel corresponding to the respective position is placed in flow communication with the fluid inlet 106, and the motive fluid 114 traverses the respective axially extending fluid channel and is directed toward the fluid driven motor 104. The total motive fluid 114 flow directed toward the fluid driven motor 104 is the combined total of the motive fluid 114 flows through each of the axially extending fluid channels 204, 208, $n^{th}$ which are in flow communication with the fluid inlet 106. Therefore, the greater the number of axially extending fluid channels, the greater the number of speeds at which the fluid driven motor 104 can potentially be operated.

Referring to FIG. 5C, the second plunger 404 can be axially displaced by the actuator 110. When the motive fluid 114 is traversing all of the axially extending fluid channels in the first plunger 202, continued depression 602 of the trigger 110 can result in linear movement of the second plunger 404 to an open position 604. In various forms, the second plunger 404 can be displaced directly by the actuator 110, or via relative motion of the first plunger 202 relative the second plunger 404. For example, the second plunger 404 can be displaced by a protrusion 606 extending from the first plunger. The linear movement of the second plunger 404 can result in a fully open position of the valve assembly 108, thereby permitting a maximum flow of the motive fluid 114 to the fluid driven motor 104. As was aforementioned, the second plunger 404 can additionally have a plurality of axially extending channels, wherein displacement of the second plunger to a first through $n^{th}$ position places a first through $n^{th}$ axially extending channel in flow communication with the fluid inlet 106, as was previously discussed with reference to the first plunger 202.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A system, comprising:

a fluid driven motor structured to be driven in a drive direction at variable speeds through action of a motive fluid; and a valve assembly having a plurality of fluid channels selectively uncovered from a cover surface of a cover member through movement of a first plunger such that the motive fluid is permitted to flow to the fluid driven motor, the first plunger having a range of positions in which to sequentially uncover the plurality of fluid channels to carry the motive fluid and provide a variable flow rate of the motive fluid through the valve assembly as a consequence of uncovering the fluid channels from the cover surface of the cover member, the variable flow rate of the motive fluid providing a variable speed output of the fluid driven motor.

2. The system of claim 1, wherein the first plunger is a first slidable plunger, and which further includes an actuator structured to selectively displace the first slidable plunger from a first position to a second position.

3. The system of claim 2, wherein the first plunger includes a formation forming the plurality of fluid channels.

4. The system of claim 2, which further includes a second plunger selectively displaced by the actuator, the second plunger forming the cover member is structured to permit a flow of motive fluid to the fluid driven motor in addition to a flow of motive fluid provided by the first slidable plunger.

5. The system of claim 4, wherein a fluid flow received by the fluid driven motor from the displacement of the second plunger exceeds a fluid flow received by the fluid driven motor from a maximum displacement of the first plunger.

6. The system of claim 4, wherein the plurality of fluid channels are axially extending fluid channels, and wherein each of the plurality of axially extending fluid channels are axially staggered relative to a neighboring fluid channel such that the staggered relationship provides selective exposure of the fluid channels as the first slidable plunger is slid between a first position and a second position.

7. The system of claim 6, wherein the plurality of fluid channels includes at least three axially extending fluid channels.

8. The system of claim 1, wherein the valve assembly is structured to be in fluid communication with a source of fluid pressurization, and wherein the source of fluid pressurization is an air compressor.

9. The system of claim 8, further including a housing which defines at least a portion of an air driven power tool, wherein the housing includes the fluid driven motor and the valve assembly, and wherein an actuator used to alter a position of the first plunger is a trigger.

10. The system of claim 1, which further includes a second plunger structured to provide a flow passage area for flow of the motive fluid in addition to a flow provided by the first plunger, the second plunger actuated by movement of the first plunger.

11. An apparatus, comprising:

a fluid driven motor structured to be driven with a motive fluid; and a valve assembly having a first plunger disposed within a housing such that cooperative engagement of the first plunger and housing form a plurality of fluid channels therebetween that can be sequentially uncovered by relative movement of the first plunger and housing, the first plunger having a first position corresponding to closure of at least one of the plurality of fluid channels such that motive fluid is discouraged from traversing the at least one of the plurality of fluid channels to flow to the fluid driven motor and a second position corresponding to an exposure of two or more of the plurality of fluid channels such that motive fluid is capable of traversing the two or more of the plurality of fluid channels to flow to the fluid driven motor.

12. The apparatus of claim 11, which further includes a second plunger structured to be positioned such as to provide an additional flow area in which motive fluid can traverse to the fluid driven motor after all of the plurality of fluid channels formed by interaction of the housing and the first plunger are placed in fluid communication with the fluid driven motor, wherein the flow of the motive fluid to the fluid driven motor is increased by displacement of the second plunger.

13. The apparatus of claim 11, wherein the plurality of fluid channels are oriented axially relative to a displacement axis of the first plunger.

14. The apparatus of claim 13, wherein each of the axially oriented fluid channels further include a fluid intake, and wherein each fluid intake is located at a different axial station in relation to each of the other fluid intakes.

15. The apparatus of claim 11, wherein an inlet passage that provides motive fluid to the valve assembly is approximately perpendicular to a fluid inlet that directs motive fluid to the fluid channels formed by the first plunger and housing, and which further includes a seal between the housing and an outer surface of the first plunger.

* * * * *